US006244325B1

(12) United States Patent
Miller et al.

(10) Patent No.: US 6,244,325 B1
(45) **Date of Patent: *Jun. 12, 2001**

(54) SAFETY RELEASE CLUTCH FOR ROLLING SHUTTERS

(75) Inventors: James V. Miller, Glen Ellyn; Michael J. Coniglio, Arlington Heights; Garrett C. Waecker, Des Plaines, all of IL (US)

(73) Assignee: QMI Roll Shutter Supply, Elmhurst, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/429,335

(22) Filed: Oct. 28, 1999

Related U.S. Application Data

(63) Continuation of application No. PCT/US99/17809, filed on Aug. 3, 1999, which is a continuation-in-part of application No. 09/129,530, filed on Aug. 5, 1998, now Pat. No. 5,975,185.

(51) Int. Cl.[7] ..... E06B 9/56
(52) U.S. Cl. ..... 160/310; 74/625
(58) Field of Search ..... 160/310, 311, 160/188, 189, 133, 9, 312; 74/625

(56) References Cited

U.S. PATENT DOCUMENTS 4,060,310 * 11/1977 Brown ..... 160/310 X
5,040,843 * 8/1991 Russell et al. ..... 74/625 X

FOREIGN PATENT DOCUMENTS 0 751 278 2/1997 (EP) .
9-88458 3/1997 (JP) .

OTHER PUBLICATIONS

Communication Relating to the Results of the International Search, International Application No. PCT/US99/17809, mailed Nov. 29, 1999.

* cited by examiner

*Primary Examiner*—David M. Purol
(74) *Attorney, Agent, or Firm*—Marshall, O'Toole, Gerstein, Murray & Borun

(57) ABSTRACT

The present invention is directed to a modular roll-up partition assembly, such as a rolling protective shutter, implementing an improved mechanism for raising the partition in an emergency by disengaging a motor from a rolling shutter. The mechanism includes a cable that passes through an axial passage in a torsion spring. When the cable is pulled, the coupling mechanism is separated from the motor drive shaft, thereby disengaging the motor drive shaft from the shutter support member and permitting the torsion spring to quickly raise the rolling shutter.

30 Claims, 6 Drawing Sheets

SAFETY RELEASE CLUTCH FOR ROLLING SHUTTERS

CROSS-REFERENCE TO RELATED APPLICATION

This application is a continuation of International Application No. PCT/US99/17809 filed Aug. 3, 1999, which is a continuation-in-part of co-pending U.S. application Ser. No. 09/129,530, filed Aug. 5, 1998 now U.S. Pat. No. 5,975,185.

BACKGROUND OF THE INVENTION

The present invention is directed to a roll-up partition system assembly which has a protective partition for covering a window or door opening that may be rolled up into a housing when not in use. More particularly, the present invention is directed to a modular assembly implementing an improved emergency opening mechanism for roll-up partition systems. The embodiments disclosed herein illustrated the various aspects of the present invention applied to one particular type of roll-up partition system: rolling protective shutters formed from a plurality of interconnected slats. It will be apparent to those of ordinary skill in the art that the present invention has application in other systems wherein a partition member is coupled to and rolls up onto a support member within a housing, such as roll-up doors, roll-up grills, roll-up gates, fire doors and the like. The application of the present invention to the various types of roll-up partition systems is contemplated by the inventor.

One type of roll-up partition system is a rolling protective shutter. Rolling protective shutters are conventional and are used to provide protection against extreme weather conditions and to deter theft, for example. One such rolling protective shutter is disclosed in U.S. Pat. No. 4,345,635 to Solomon. As shown in FIGS. 1 and 2 of that patent, the Solomon shutter is composed of a plurality of elongate slats, each of which has a pair of circular ribs attached to its sides. The slats are interconnected by a plurality of elongate hinges, each of which has a pair of circular apertures in which the circular ribs of the slats are disposed. When the Solomon shutter is unrolled to its protective position, each of the slats in the shutter is disposed vertically with the ends of the slats disposed within guide channels or side tracks on either side of the opening. When not in use, the Solomon shutter may be rolled up into a housing disposed at the upper end of the protective shutter.

Another type of rolling protective shutter is disclosed in U.S. Pat. No. 5,575,322 to Miller. As shown, the shutter assembly includes a shutter support member mounted for rotation in a shutter housing. A rolling shutter composed of a plurality of individual slats is coupled to the shutter support member so that the shutter can be rolled up onto the shutter support member. A pair of shutter tracks extend downwardly from either end of the shutter housing. When the shutter is in its unrolled position, the ends of the slats are disposed within the tracks.

Roll-up partitions in general, and rolling protective shutters in particular, typically incorporate one or more torsion spring assemblies to assist in rolling and unrolling the shutters manually or by a powered opening device. In one arrangement, the assembly is a self-contained modular unit having a spring shaft surrounded by a coiled torsion spring. One end of the spring shaft includes a spring shaft support that is rotatable about the spring shaft, and a spring plate rigidly fixed to the spring shaft and to the proximate end of the torsion spring to prevent rotation of the end of the torsion spring relative to the spring shaft. The other end of the spring shaft includes a spring drive that is rotatable about the spring shaft and rigidly fixed to the other end of the torsion spring. The assembly is inserted into the shutter support member with one end of the spring shaft rigidly fixed to the shutter housing. The spring shaft support and spring drive engage the interior of and rotate with the shutter support member. When the shutter is unrolled, the torsion spring is wound tighter, thereby providing additional torque to assist in lifting and rolling the shutter onto the shutter support member. During normal operation of the rolling protective shutters, the torsion spring exerts a minimum torque when the shutter is in the rolled position and a maximum torque when the shutter is in the unrolled position.

The torsion spring therefore assists in lifting the shutter to an open position, whether motor driven or manually operated. In many municipalities, it is required that a person could easily pull a lever and have any type of security door or gate open ("pop up") for easy and fast egress in case of an emergency, such as, for example, a fire, inside the building on which the security door or gate is installed. This "pop up" operation must be done mechanically rather than by electrical power, in the event that electrical power is interrupted due to the fire or other emergency in the building.

Accordingly, it is necessary to have a system that enables a torsion spring to raise the door or gate by a manual operation. Typically, motor driven security doors or gates use a braking system of some type to maintain the position of the door or gate when the motor is stopped. This braking system must be disengaged when the door or gate needs to be raised.

A typical type of overhead door uses a large motor mounted outside of a housing that contains the door or gate when it is rolled up. The motor can be hidden in the ceiling of the building in which the door or gate is installed. Through the use of gears and/or chains, it has been fairly easy to provide a mechanism to disengage the braking system and permit the torsion spring to raise the shutter. However, this type of external motor system is extremely costly, very large, difficult to install, and can be unsightly if it cannot be hidden in a ceiling.

One primary alternative to such external motor systems is the use of tubular motors to raise and lower doors and gates. Tubular motors can be encased inside of a roller tube around which the door or gate is wound when the door or gate is opened. As the motor system is always hidden within the roller tube, it is never visible and thereby gives the door or gate a very clean look. The use of a tubular motor also makes installation of the door or gate much simpler.

Present designs for rolling doors or gates having tubular motors do not have satisfactory mechanisms for utilizing a torsion spring to raise the door in an emergency. Typically, a cable mechanism is used to manually release a brake inside the tubular motor. Such cable mechanisms do not work well in practice because the required travel of the cable is so small in order to effectively release the brake that the cable mechanisms either simply do not work or are extremely difficult to install properly. Accordingly, presently there are no known commercial manufacturers of tubular motors that offer a system for rolling up a door or gate in an emergency.

In other installations, it is desirable to disengage the tubular motor from the partition to allow the partition to be unrolled in an emergency. For example, fire doors are unrolled to cover an opening to prevent the spread of a fire. In the event the fire causes a power outage, it is necessary to disengage the tubular motor and manually unroll the shutter to cover the opening. Accordingly, its is desirable to provide a safety release mechanism that allows a partition to be either rolled up or unrolled in an emergency.

In view of the foregoing problems and disadvantages, there is a need for a system that can be used with a tubular motor that enables the use of a torsion spring to open or close a door or gate in case of an emergency.

SUMMARY OF THE INVENTION

The present invention is directed to a roll-up partition assembly, such as a rolling protective shutter, implementing an improved mechanism for opening the partition assembly in an emergency situation.

In accordance with a preferred embodiment of the present invention, a mechanism is provided for disengaging a motor from a roller tube of a rolling shutter. The mechanism includes a manually operable actuating member that passes through an axial passage in a torsion spring. The manually operable actuating member is connected to a coupling mechanism. When the manually operable actuating member is pulled, the coupling mechanism is separated from the motor drive shaft, thereby disengaging the roller tube from the motor drive shaft.

In an alternative embodiment of the present invention, the coupling mechanism further includes a clutch drive coupled to the drive shaft and a detent holder coupled to the roller tube. A detent is disposed within the detent holder and operatively coupled to the actuating member. When the actuating member is not pulled, the detent couples the detent holder to the clutch drive. When the actuating member is pulled, the detent releases the clutch drive, thereby disengaging the detent holder from the clutch drive.

The features and advantages of the invention will be apparent to those of ordinary skill in the art in view of the detailed description of the preferred embodiment, which is made with reference to the drawings, a brief description of which is provided below.

DETAILED DESCRIPTION OF THE PREFERRED EMBODIMENTS

Figure 1:
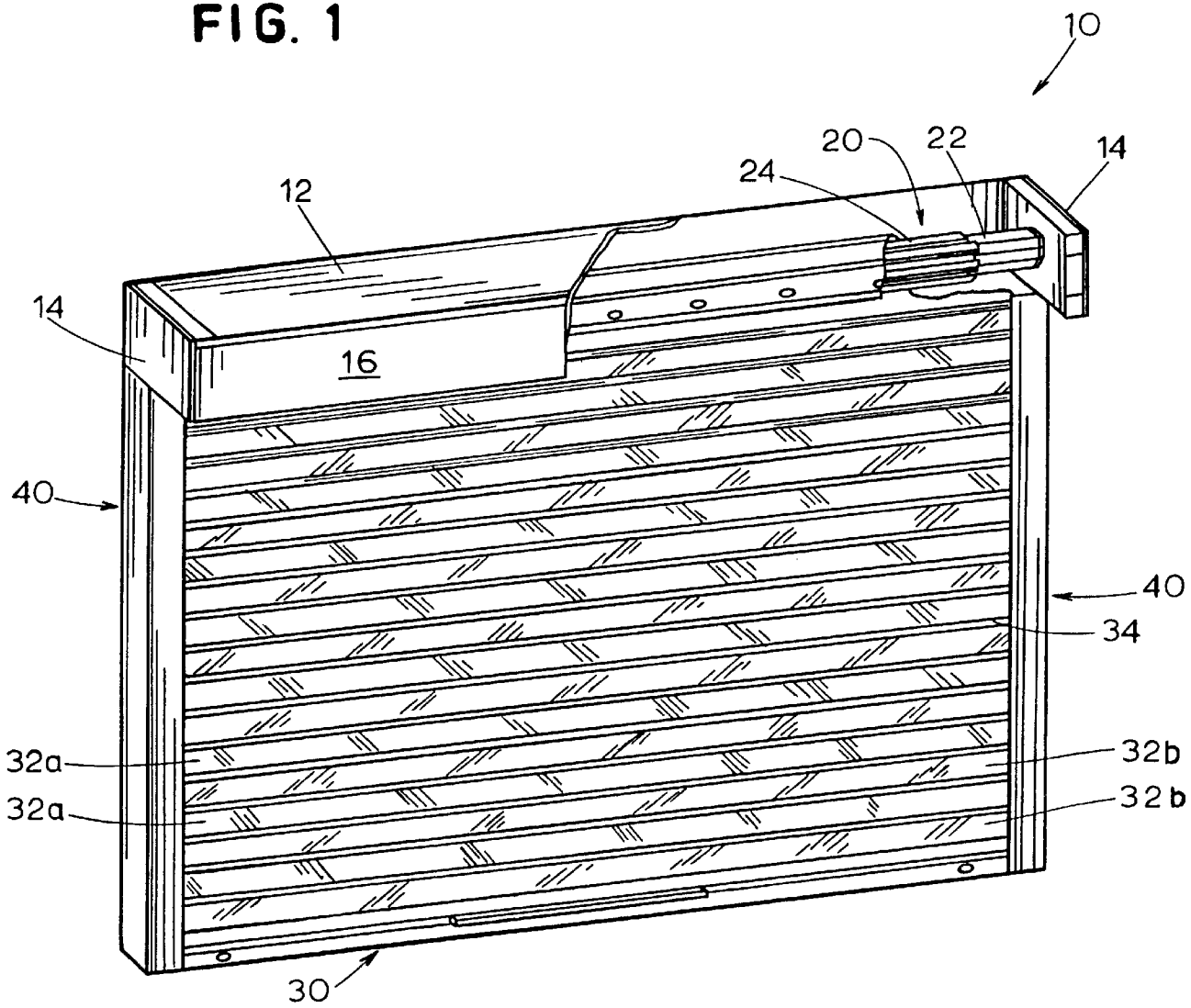
FIG. 1 is a perspective view of a rolling shutter assembly that can implement the present invention.
Figure 2:
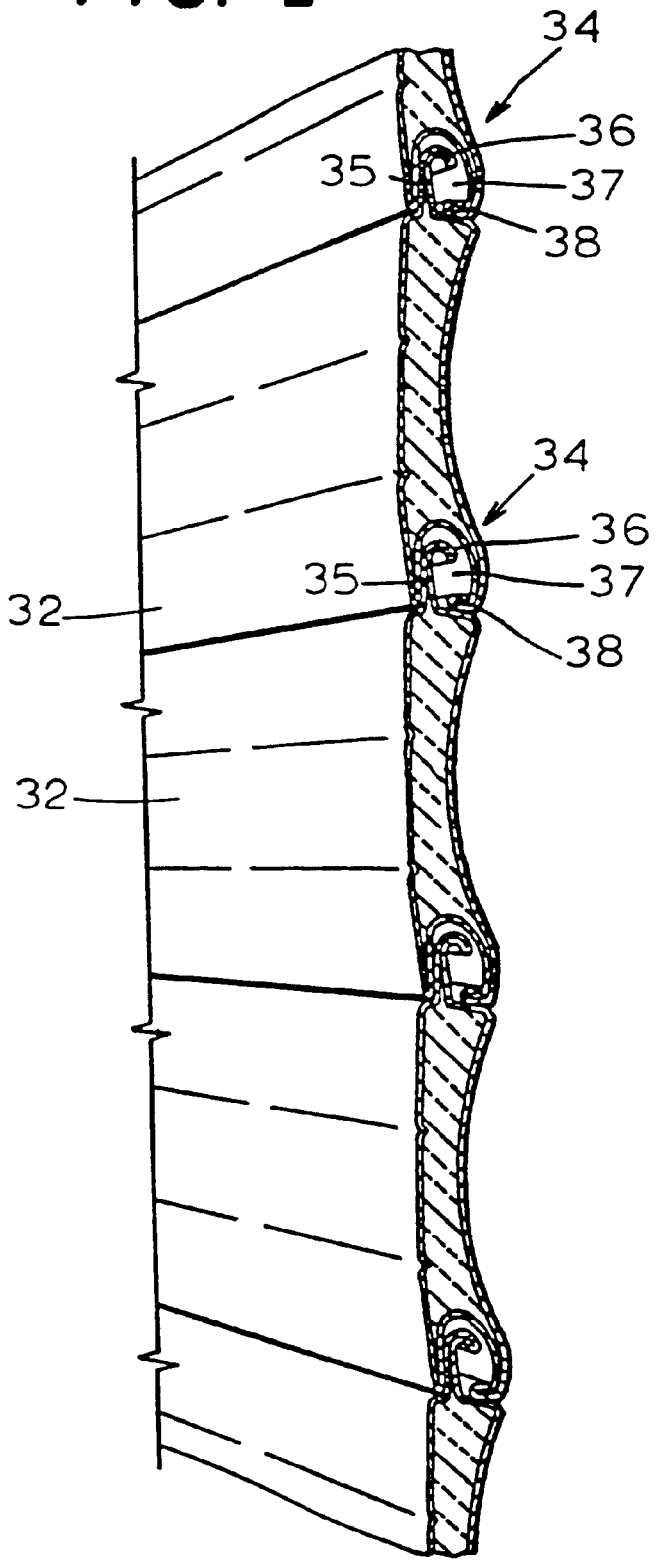
FIG. 2 is a fragmentary perspective view of a portion of the shutter of the shutter assembly of FIG. 1.
Figure 3:
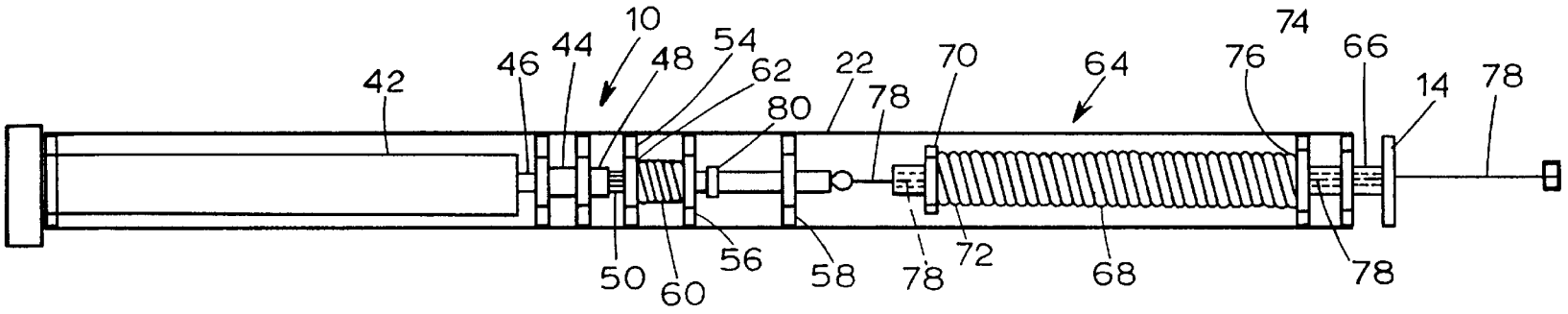
FIG. 3 is a schematic top view of a portion of the shutter assembly of FIG. 1, in a configuration for normal, motorized operation.

One type of roll-up partition system, rolling shutter assembly 10, that may implement the present invention is shown in FIGS. 1–3. Referring to FIG. 1, the shutter assembly 10 has a shutter housing which includes a top wall 12, a pair of side walls 14, and a front wall 16. A partition support member 20 is mounted for rotation within the shutter housing. The support member 20 includes a generally cylindrical central roller tube 22 and a plurality of mounting members 24 fixed to the roller tube 22.

The upper end of a rolling shutter 30 is coupled to the mounting members 24. Alternatively, however, the mounting members 24 may be omitted and the rolling shutter 30 mounted directly to the roller tube 22. The shutter 30 is composed of a plurality of individual, elongate slats 32. One example of a configuration of slats 32 is illustrated in FIG. 2. The slats 32, each of which is substantially flat, having two substantially planar side portions, and may be composed of steel, are interconnected by a plurality of hinges 34, each of which joins together a pair of adjacent slats 32.

Each of the slats 32 includes an upward projection 35 extending longitudinally along the upper edge of the slat 32 and having a rearwardly and downwardly extending hook 36 at the top. Each of the slats 32 further includes a downward facing U-shaped recess 37 extending longitudinally along the lower edge of the slat 32 and having a forward horizontal projection 38 formed on the rear edge of the recess 37. The hook 36 of a lower slat 32 and the recess 37 and projection 38 of an upper slat 32 interlock to form each hinge 34.

Instead of being integrally formed with the shutter slats 32, the hooks 36 and U-shaped recesses 37 described above could be separate components connected thereto, such as by bolting or riveting. Instead of hooks and recesses, other locking members having different structures could be used to form the hinges. Other configurations of slats 32 and interconnecting hinges 34, such as the configuration of the Solomon shutters, are well known in the art and are contemplated by the inventor as having use with the present invention.

Referring back to FIG. 1, the ends of the slats 32 are disposed within a pair of shutter tracks 40. When mounted to protect a window or other opening, the shutter tracks 40 of the shutter assembly 10 are positioned on either side of the opening and the shutter housing is positioned over the top of the opening. Alternatively, in some applications, the side tracks 40 and shutter housing are positioned within the opening.

The shutter assembly 10 includes a tubular electric motor 42 (shown schematically in FIGS. 3 and 4) disposed within the roller tube 22. When the shutter 30 is not in use, it is rolled up on the roller tube 22 via the motor 42 so that it is at least partially enclosed by the shutter housing.

Figure 4:
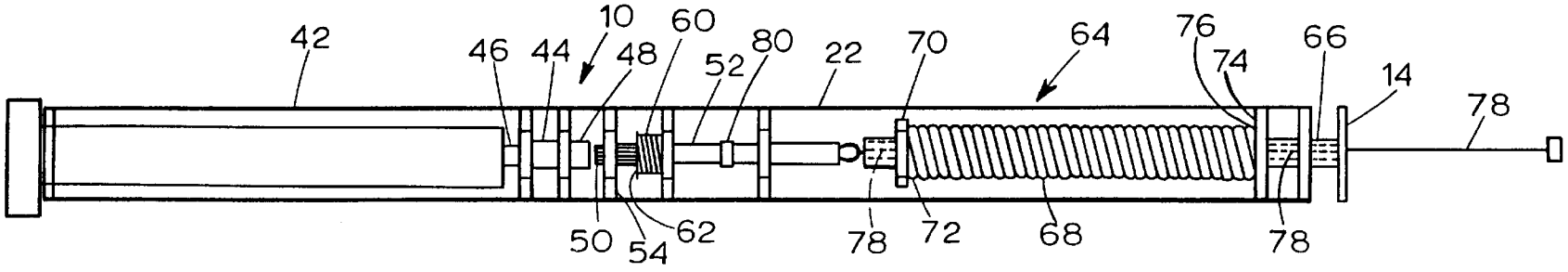
FIG. 4 is a schematic top view of a portion of the shutter assembly of FIG. 1, in a configuration for emergency, manual operation.

Now referring to FIGS. 3 and 4, the motor 42 is directly coupled to the roller tube 22, on which the shutter rolls up, by means of a motor drive coupling 44 driven by a motor shaft 46 extending from the motor 42. The motor drive coupling includes a splined socket portion 48 that mates with a splined end portion 50 of an axially movable drive shaft 52. The splined end portion 50 also mates with a splined drive plate 54 that is fixedly secured to the roller tube 22 for rotation therewith. The axially movable drive shaft 52 passes through a first spacer plate 56 and a second spacer plate 58. A compression spring 60 wrapped around the axially movable drive shaft 52 is disposed between the first spacer plate 56 and a compression spring plate 62 that is fixed to the axially movable drive shaft 52. The compression spring 60 tends to press the axially movable drive shaft 52 toward the left as shown in FIG. 3, and thus tends to press the splined end portion 50 of the movable drive shaft 52 into engagement with the splined socket portion 48 of the motor drive coupling 44.

As previously discussed, roll-up partition assemblies incorporate torsion springs to assist in lifting and rolling the shutters. Referring to the right hand portion of FIGS. 3 and 4, the shutter assembly 10 includes a torsion spring assembly 64 that facilitates ease of movement of the shutter 30 from the unrolled position to the rolled position. The torsion spring assembly 64 includes a hollow spring shaft 66 surrounded by a coiled torsion spring 68 disposed within the roller tube 22. The hollow spring shaft 66 is anchored to the side wall 14 on the right hand side of the rolling shutter assembly 10.

A torsion spring plate 70 is rigidly mounted to the hollow spring shaft 66. The outer diameter of the torsion spring plate 70 is small enough to allow the roller tube 22 to rotate relative to the hollow spring shaft 66 without engaging the outer surface of the torsion spring plate 70. The torsion spring plate 70 is rigidly connected to a first end 72 of the coiled torsion spring 68 to prevent rotation of the first end 72 of the coiled torsion spring 68 relative to the hollow spring shaft 66.

The counterbalancing mechanism further includes a spring drive 74 rotatably mounted to the hollow spring shaft 66 adjacent a second end 76 of the coiled torsion spring 68 opposite the first end 72 thereof. The spring drive 74 is rigidly attached to the roller tube 22 for rotation therewith. The second end 76 of the coiled torsion spring 68 is coupled to the spring drive 74 and rotates with the roller tube 22 relative to the hollow spring shaft 66. When the rolling shutter 30 is unrolled, the coiled torsion spring 68 is wound tighter as the second end 76 connected to the spring drive 74 rotates relative to the first end 72 connected to the torsion spring plate 70, thereby providing additional torque to assist in lifting and rolling the shutter 30 onto the roller tube 22.

A manually operable actuating member 78 passes through the hollow spring shaft 66 and is connected to the axially movable drive shaft 52. A bearing 80 is disposed between the manually operable actuating member 78 and the axially movable drive shaft 52, to prevent twisting of the manually operable actuating member 78 when the roller tube 22 and the axially movable drive shaft 52 are rotated to raise or lower the shutter 30. The manually operable actuating member 78 can be in the form of a flexible steel cable or a rigid metal rod. When the manually operable actuating member 78 is pulled, the compression spring 60 is compressed and the axially movable drive shaft 52 is moved toward the right, as seen in FIG. 4, disengaging the axially movable drive shaft 52 from the splined socket portion 48. Once disengaged from the splined socket portion 48, the axially movable drive shaft 52 is disconnected from the motor 42, permitting the torsion spring assembly 64 to raise the rolling shutter 30 without having to overcome the torque required to turn the motor 42. The manually operable actuating member 78 may then be released after the shutter 30 has been raised using the torsion spring assembly 64.

Once the manually operable actuating member 78 is released, the compression spring 60 presses the axially movable drive shaft 52 toward the left, as seen in FIG. 3, re-engaging the axially movable drive shaft 52 to the splined socket portion 48. The rolling shutter assembly 10, is therefore ready to be operated using the motor 42.

In installations for larger rolling shutters or doors, larger torsion springs are used to counterbalance the weight of the shutter or door. Consequently, the torsion springs exert greater torque on the roller tube when the curtain is unrolled. The additional torque results in greater friction between splined socket portion 48 and splined end portion 50 as described above, thereby requiring more effort to pull the portions 48, 50 apart to release the roller tube 22 from the motor 42.

Figure 5:
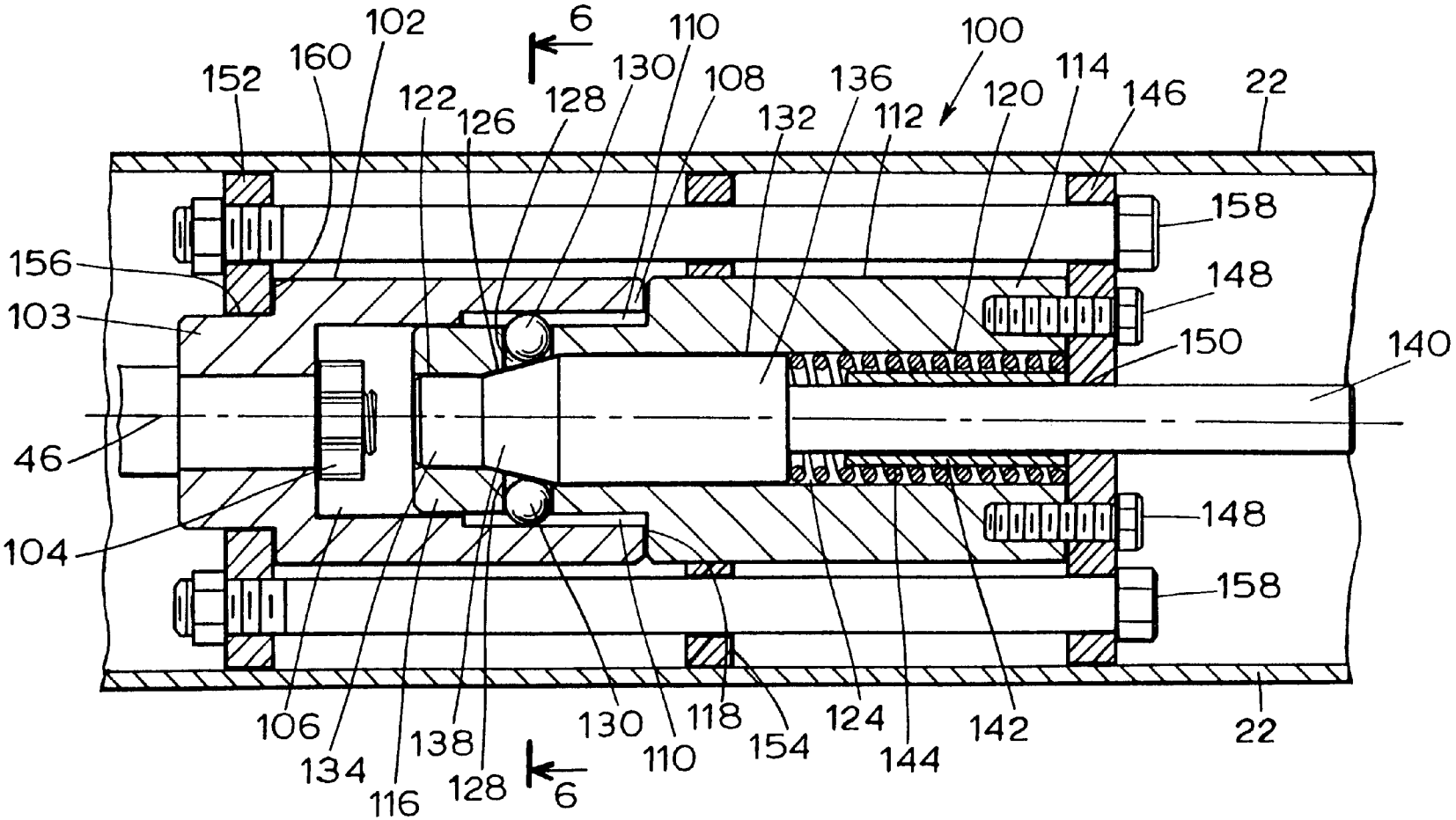
FIG. 5 is a partial sectional view of a safety release clutch according to the present invention in the engage position.

FIGS. 5–9 illustrate an alternative embodiment of a mechanism for disengaging the motor 42 from roller tube 22. Referring to FIG. 5, a safety release clutch 100 replaces the pop-up safety device of FIGS. 3 and 4. The safety release clutch 100 is disposed within the roller tube 22 between the motor and the hollow spring shaft (not shown). The clutch 100 includes a clutch drive 102 connected to the motor shaft 46 for rotation therewith. The clutch drive 102 is secured at the shaft end 103 to the motor shaft 46 by a nut 104 to prevent axial movement of the clutch drive 102 relative to the motor shaft 46. The clutch drive 102 has an axial bore 106 in the clutch end 108 opposite the motor shaft 46, with four notches or recesses 110 spaced about the inner wall of the axial bore 106.

The safety release clutch 100 further includes a ball holder 112 axially aligned with the clutch drive 102. The ball holder 112 has a body 114 and a circular tip 116. The tip 116 is dimensioned to be inserted into the axial bore 106 of the clutch drive 102 until a shoulder 118 between the body 114 and tip 116 abuts the clutch end 108. The tip 116 is slightly smaller than the axial bore 106 of the clutch drive 102 to allow rotation of the ball holder 112 relative to the clutch drive 102.

The ball holder 112 has an axial throughbore 120 having a narrow portion 122 proximate the clutch drive 102 and an intermediate wide portion 124 opposite the clutch drive 102 joined by a tapered portion 126. The ball holder 112 also has four radial bores 128 spaced about the central axis of the throughbore 120 that connect the exterior of the tip 116 and the tapered portion 126 of the throughbore 120. The radial bores 128 form races for ball bearings 130 that couple the ball holder 112 to the clutch drive 102 in a manner described more thoroughly below.

A plunger 132 is slidably disposed within the axial throughbore 120 of the ball holder 110. The plunger 132 includes a tip 134, a body 136 and a tapered portion 138 that correspond to the narrow portion 122, wide portion 124 and tapered portion 126, respectively, of the throughbore 120. The plunger 132 further includes an axial shaft 140 extending outwardly from the plunger body 136 in the direction opposite the clutch drive 102 and beyond the end of the body 114 of the ball holder 112. The plunger shaft 140 has a smaller diameter than the throughbore 120 and the plunger body 136. The shaft 140 is surrounded by a bushing 144 and a coil spring 144 that are disposed within the throughbore 120 and between the plunger body 136 and the end of the ball holder 114. The bearing 142 and spring 144 are held within the throughbore 120 by a drive plate 146 that abuts the end of the ball holder body 114 and is held against the body 114 by fasteners such as screws 148. The plunger shaft 140 extends through an axial opening 150 in the drive plate 146 and is slidable therein. The end of the plunger shaft 140 is connected to the actuating member 78 by a bearing 80 in the same way described for the drive shaft 52 of FIGS. 3 and 4.

Clutch drive plate 152 and ball holder drive plate 154 provide additional support for the safety release clutch 100 within the roller tube 22. The clutch drive plate 152 is disposed proximate the shaft end of the clutch drive 102 and has an opening 156 through the shaft end 103 of the clutch drive 102 is inserted. The opening 156 and the shaft end 103 are dimensioned so that the shaft end 103 may rotate relative to the clutch drive plate 152. The ball holder drive plate 154 is disposed about the body 114 of the ball holder 112 and is coupled to the body 114 so that the ball holder 112 and drive plate 154 rotate together. The plates 146, 152, 154 are coupled to the roller tube 22 for rotation therewith. Consequently, when the shutter is rolled or unrolled, the plates 146, 152, 154 and ball holder 112 rotate with the roller tube 22.

The plates 146, 152, 154 and, consequently, the safety release clutch 100 are held together by fasteners, such as screws 158. The screws 158 prevent the plates 146, 152 from moving axially in opposite directions, thereby keeping the plunger 132 and ball holder tip 116 disposed within the axial bore 100 of the clutch drive 102. Moreover, the plate 152 engages a shoulder 160 between the shaft end 103 and clutch end 108 of the clutch drive 102 to further prevent the ball holder 112 and plunger 132 from separating from the drive clutch 102. Although the plates 146, 152 hold the clutch 100 together, the screws 158 are not clamped so tight that the friction between the shoulder 118 and clutch end 108, and the shoulder 160 and drive plate 152 prevents the ball holder 112 and drive plate 152 from rotating relative to the motor shaft 46 and drive clutch 102 when the safety release clutch 100 is disengaged.

Figure 6:
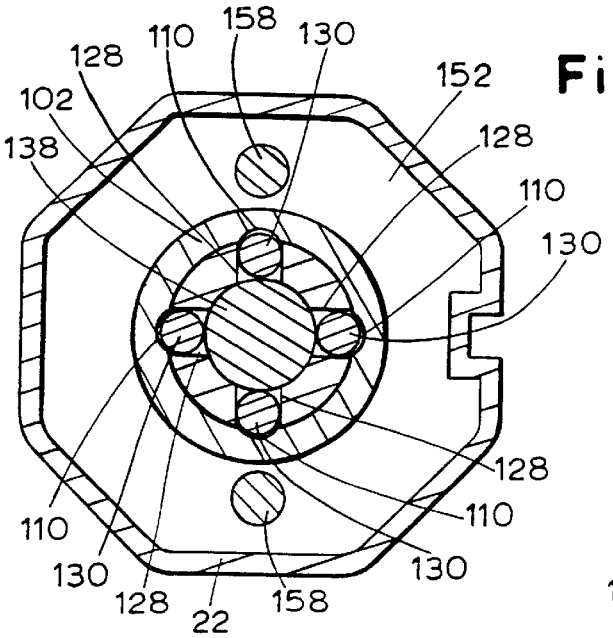
FIG. 6 is a sectional view taken through line 6—6 of the safety release clutch of FIG. 5.

FIGS. 5 and 6 illustrate the safety release clutch 100 in the engaged position. The spring 144 exerts a force against the drive plate 146 and biases the plunger body 136 into mating relationship with the throughbore 120 of the ball holder 112. When the races 128 are aligned with the recesses 110 in the axial bore 106 (FIG. 6), the ball bearings 130 are forced into the recesses 110 by the tapered portion of the plunger 132, and the plunger 132 mates with the throughbore 120. The ball bearings 130 engage the recesses 110, resulting in an interference fit between the clutch drive 102 and the ball holder 112 as both elements engage the ball bearings 130. In this position, the motor shaft 46, clutch drive 102, ball holder 112 and roller tube 22 rotate together when the motor drives the motor shaft 46. The spring 144 is designed to exert enough force to prevent axial movement of the plunger 132 as the ball bearings 130 exert a force on the tapered portion 138 as the motor raises and lowers the shutter curtain.

Figure 8:
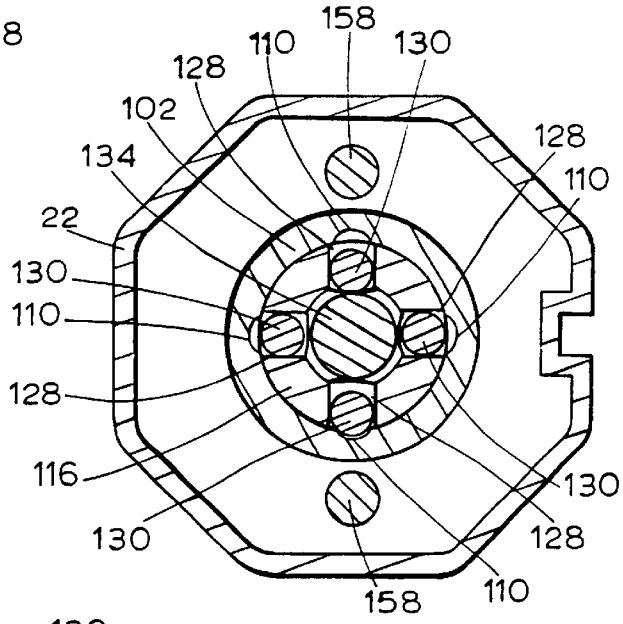
FIG. 8 is a sectional view taken through line 8—8 of the safety release clutch of FIG. 6.
Figure 9:
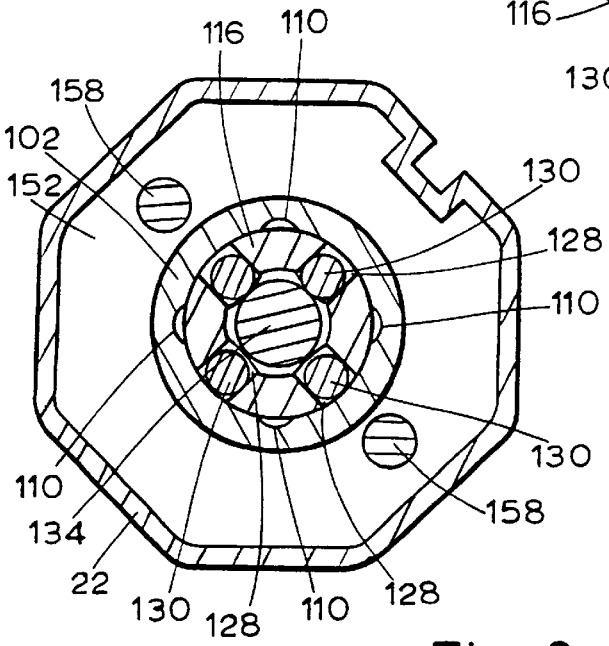
FIG. 9 is a sectional view of the safety release clutch of FIG. 8 after a 45° rotation of the roller tube.
Figure 7:
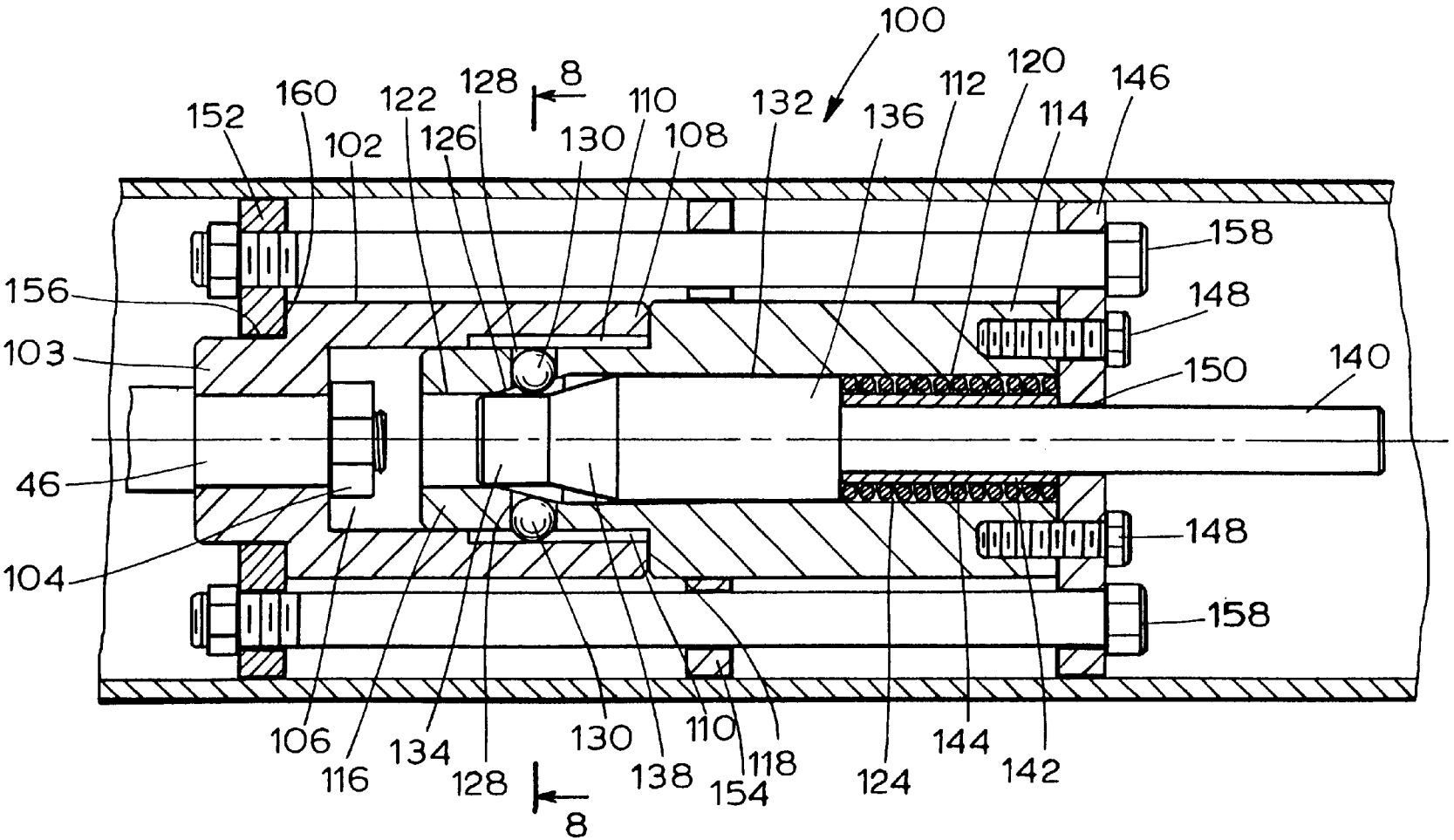
FIG. 7 is a partial sectional view of the safety release clutch of FIG. 5 in the disengaged position.

The safety release clutch 100 disengages the roller tube 22 from the motor shaft 46 when the actuating member 78 is pulled. FIGS. 7–9 show the clutch 100 in the disengaged position. As previously discussed, the plunger shaft 140 is coupled to the actuating member 78. When the actuating member 78 is pulled, the plunger 132 moves axially against the force of the spring 144 until the plunger body 136 engages the bushing 142. In this position, the tapered portion 138 of the plunger 132 has moved past the ball bearings 130 and is replaced by the tip portion 134. The distance between outer surface of tip portion 134 and the outer surface of the ball holder tip 116 is greater than the diameter of the ball bearings 130. As a result, the ball bearings 130 are free to move within the races 128 and are not forced to stay in the recesses 110 of the axial bore 106. When the roller tube 22 and the components of the safety release clutch 100 attached thereto rotate with respect to the motor shaft 46 and drive clutch 102, such as in FIG. 9 where the roller tube 22, plate 152 and ball holder 112 have rotated 450 with respect to the clutch drive 102, the ball bearings 130 are free to retreat into the races 128 as the races 128 pass the recesses 110. When the actuating member 78 is released, the spring 144 biases the plunger 132 toward the drive clutch 102 and the tapered portion 138 forces the ball bearings 130 outwardly through the races 128. When the recesses 110 of the axial bore 106 align with the races 128, the ball bearings 130 are forced into the recesses 110 to couple the ball holder 112 to the clutch drive 102, thereby reengaging the clutch 100.

The embodiments disclosed herein illustrate the various aspects of the present invention applied to a rolling protective shutter. It will be apparent to those skilled in the art that the present invention may be applied to other systems wherein a partition member is coupled to a support member and rolled up into a housing. Such partition systems include roll-up doors, roll-up grills, roll-up gates and the like. The application of the present invention to the various types of roll-up partition systems is contemplated by the inventor.

Other modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. An apparatus for disengaging a motor-driven overhead door for raising the door, comprising:

a motor having a drive shaft;

a rotatable partition support member;

a torsion spring defining an axial passage; and a means for selectively coupling said partition support member to said drive shaft for rotation therewith;

said selectively coupling means comprising an actuating member at least partially passing through said axial passage;

wherein said actuating member is adapted to move from a first position at which said partition support member is coupled to said drive shaft for rotation therewith, and a second position at which said partition support member is uncoupled from said drive shaft.

2. The apparatus of claim 1, wherein said actuating member comprises a steel cable.

3. The apparatus of claim 1, wherein said actuating member comprises a metal rod.

4. The apparatus of claim 1, further comprising a bearing mounted between said drive shaft and said actuating member, said bearing substantially preventing twisting of said actuating member due to rotation of said drive shaft.

5. The apparatus of claim 1, wherein said selectively coupling means further comprises:

a clutch drive coupled to said drive shaft for rotation therewith;

a detent holder coupled to said partition support member for rotation therewith; and a detent at least partially disposed within said detent holder and operatively coupled to said actuating member, said detent being adapted to selectively couple said detent holder to said clutch drive for rotation therewith;

wherein said detent couples said detent holder to said clutch drive when said actuating member is in said first position and said detent holder and said clutch drive are uncoupled when said actuating member is in said second position.

6. The apparatus of claim 5, wherein said clutch drive has an axial bore, said detent holder has a tip portion disposed at least partially within said axial bore, and said detent engages said axial bore when said actuating member is in said first position thereby coupling said detent holder to said clutch drive.

7. The apparatus of claim 6, wherein said axial bore of said clutch drive has a recess, said tip portion of said detent holder having an opening with said detent disposed therein, and wherein said coupling mechanism further comprises a plunger disposed within said detent holder and having a tapered portion, said plunger being operatively coupled to said actuating member so that said tapered portion of said plunger engages said detent to cause said detent to extend partially through said opening and into said recess when said actuating member is in said first position.

8. The apparatus of claim 1, wherein said motor is disposed within said partition support member.

9. A roll-up partition assembly, comprising:

a partition housing;

a partition support member disposed within said partition housing;

a partition member coupled to said partition support member;

a pair of side tracks;

a tubular motor disposed within said partition support member and having a drive shaft;

a torsion spring defining an axial passage disposed within said partition support member and having a first end coupled to said partition support member for rotation therewith and a second end coupled to said partition housing;

a coupling mechanism adapted to selectively couple said partition support member to said drive shaft for rotation therewith;

said coupling mechanism comprising an actuating member at least partially passing through said axial passage;

wherein, said actuating member is adapted to move from a first position at which said partition support member is coupled to said drive shaft for rotation therewith, and a second position at which said partition support member is uncoupled from said drive shaft.

10. The apparatus of claim 9, wherein said actuating member comprises a steel cable.

11. The apparatus of claim 9, wherein said actuating member comprises a metal rod.

12. The apparatus of claim 9, further comprising a bearing mounted between said drive shaft and said actuating member, said bearing substantially preventing twisting of said actuating member due to rotation of said drive shaft.

13. The apparatus of claim 9, wherein said selectively coupling means further comprises:

a clutch drive coupled to said drive shaft for rotation therewith;

a detent holder coupled to said partition support member for rotation therewith; and a detent at least partially disposed within said detent holder and operatively coupled to said actuating member, said detent being adapted to selectively couple said detent holder to said clutch drive for rotation therewith;

wherein said detent couples said detent holder to said clutch drive when said actuating member is in said first position and said detent holder and said clutch drive are uncoupled when said actuating member is in said second position.

14. The apparatus of claim 13, wherein said clutch drive has an axial bore, said detent holder has a tip portion disposed at least partially within said axial bore, and said detent engages said axial bore when said actuating member is in said first position thereby coupling said detent holder to said clutch drive.

15. The apparatus of claim 14, wherein said axial bore of said clutch drive has a recess, said tip portion of said detent holder having an opening with said detent disposed therein, and wherein said coupling mechanism further comprises a plunger disposed within said detent holder and having a tapered portion, said plunger being operatively coupled to said actuating member so that said tapered portion of said plunger engages said detent to cause said detent to extend partially through said opening and into said recess when said actuating member is in said first position.

16. The apparatus of claim 9, wherein said motor is disposed within said partition support member.

17. An apparatus for disengaging a motor-driven overhead door for raising the door, comprising:

a motor having a drive shaft;

a rotatable partition support member;

a torsion spring defining an axial passage; and a coupling mechanism for selectively mating said partition support member to said drive shaft for rotation therewith;

said coupling mechanism comprising an actuating member at least partially passing through said axial passage;

wherein, said actuating member is adapted to move from a first position at which said partition support member is mated to said drive shaft for rotation therewith, and a second position at which said partition support member is disconnected from said drive shaft.

18. The apparatus of claim 17, wherein said actuating member comprises a steel cable.

19. The apparatus of claim 17, wherein said actuating member comprises a metal rod.

20. The apparatus of claim 17, further comprising a bearing mounted between said drive shaft and said actuating member, said bearing substantially preventing twisting of said actuating member due to rotation of said drive shaft.

21. The apparatus of claim 17, wherein said selectively coupling means further comprises:

a clutch drive coupled to said drive shaft for rotation therewith;

a detent holder coupled to said partition support member for rotation therewith; and a detent at least partially disposed within said detent holder and operatively coupled to said actuating member, said detent being adapted to selectively couple said detent holder to said clutch drive for rotation therewith;

wherein said detent couples said detent holder to said clutch drive when said actuating member is in said first position and said detent holder and said clutch drive are uncoupled when said actuating member is in said second position.

22. The apparatus of claim 21, wherein said clutch drive has an axial bore, said detent holder has a tip portion disposed at least partially within said axial bore, and said detent engages said axial bore when said actuating member is in said first position thereby coupling said detent holder to said clutch drive.

23. The apparatus of claim 22, wherein said axial bore of said clutch drive has a recess, said tip portion of said detent holder having an opening with said detent disposed therein, and wherein said coupling mechanism further comprises a plunger disposed within said detent holder and having a tapered portion, said plunger being operatively coupled to said actuating member so that said tapered portion of said plunger engages said detent to cause said detent to extend partially through said opening and into said recess when said actuating member is in said first position.

24. The apparatus of claim 17, wherein said motor is disposed within said partition support member.

25. A safety release clutch for a roll-up partition assembly having a partition support member and a tubular motor with a drive shaft, comprising:

a clutch drive coupled to said drive shaft for rotation therewith;

a detent holder coupled to said partition support member for rotation therewith;

an actuating member; and a detent at least partially disposed within said detent holder and operatively coupled to said actuating member, said detent being adapted to selectively couple said detent holder to said clutch drive for rotation therewith;

wherein said actuating member is adapted to move from a first position at which said detent couples said detent holder to said clutch drive, and a second position at which said detent uncouples said detent holder from said clutch drive.

26. The safety release clutch of claim 25, wherein said clutch drive has an axial bore, said detent holder has a tip portion disposed at least partially within said axial bore, and said detent engages said axial bore when said actuating member is in said first position thereby coupling said detent holder to said clutch drive.

27. The safety release clutch of claim 26, wherein said axial bore of said clutch drive has a recess, said tip portion of said detent holder having an opening with said detent disposed therein, and wherein said coupling mechanism further comprises a plunger disposed within said detent holder and having a tapered portion, said plunger being operatively coupled to said actuating member so that said tapered portion of said plunger engages said detent to cause said detent to extend partially through said opening and into said recess when said actuating member is in said first position.

28. The safety release clutch of claim 25, wherein said actuating member comprises a steel cable.

29. The safety release clutch of claim 25, wherein said actuating member comprises a metal rod.

30. The safety release clutch of claim 25, further comprising a bearing mounted between said drive shaft and said actuating member, said bearing substantially preventing twisting of said actuating member due to rotation of said drive shaft.

* * * * *